US012134126B2

(12) United States Patent
Naujock et al.

(10) Patent No.: US 12,134,126 B2
(45) Date of Patent: Nov. 5, 2024

(54) METHOD AND STRAND GUIDE DEVICE FOR OPERATING A COOLING CHAMBER

(71) Applicant: SMS group GmbH, Düsseldorf (DE)

(72) Inventors: Andreas Naujock, Oberhausen (DE); Klaus-Peter Eberwein, Erkrath (DE); Lothar Fischer, Kaarst (DE); Jochen Wans, Meerbusch (DE); Axel Weyer, Wuppertal (DE); Ulrich Wiegard, Leverkusen (DE); Judith Ahrens, Kaarst (DE)

(73) Assignee: SMS group GmbH, Düsseldorf (DE)

( * ) Notice: Subject to any disclaimer, the term of this patent is extended or adjusted under 35 U.S.C. 154(b) by 0 days.

(21) Appl. No.: 18/357,102

(22) Filed: Jul. 22, 2023

(65) Prior Publication Data

US 2024/0033818 A1 Feb. 1, 2024

(30) Foreign Application Priority Data

Jul. 27, 2022 (DE) ..... 102022207735.0
Jun. 30, 2023 (DE) ..... 102023206241.0

(51) Int. Cl.
*B22D 45/00* (2006.01)
*B22D 11/00* (2006.01)
*B22D 11/124* (2006.01)

(52) U.S. Cl.
CPC ..... *B22D 45/005* (2013.01); *B22D 11/005* (2013.01); *B22D 11/124* (2013.01)

(58) Field of Classification Search
CPC ..... B22D 11/00; B22D 11/005; B22D 11/124; B22D 45/00; B22D 45/005
USPC ..... 164/441, 442, 447, 448, 486, 444
See application file for complete search history.

(56) References Cited

U.S. PATENT DOCUMENTS 4,509,582 A 4/1985 Kriegner
2017/0333965 A1 11/2017 Wiegard et al.

FOREIGN PATENT DOCUMENTS

| | | | |
|---|---|---|---|
| DE | 102015209399 | A1 | 5/2016 |
| DE | 102017209731 | A1 | 12/2018 |
| DE | 102006045791 | B4 | 5/2019 |
| JP | H08112647 | B | 5/1996 |
| JP | H0957408 | A | 3/1997 |
| JP | H10193062 | A | 7/1998 |
| KR | 20130008932 | A | 1/2013 |
| RU | 2007147722 | | 6/2009 |

*Primary Examiner* — Kevin P Kerns
(74) *Attorney, Agent, or Firm* — Smartpat PLC

(57) ABSTRACT

A strand guide device serves to deflect a freshly cast strand, typically made of metal, into the horizontal. During the deflection, the cast strand passes through a cooling chamber 1 inside the strand guide device 2, in which it is sprayed with a coolant 33, with the formation of steam 5. The steam forms at least a steam-air mixture 5' with sucked-in secondary air, which is sucked out of the cooling chamber by a suction device 20. In order to reduce the pollutant content of the sucked-in and sucked-off steam-air mixture 5' and its emission into the environment, pollutants, primarily dust, located in the steam-air mixture 5' are depleted by a separator 6, 6'.

21 Claims, 6 Drawing Sheets

METHOD AND STRAND GUIDE DEVICE FOR OPERATING A COOLING CHAMBER

CROSS-REFERENCE TO RELATED APPLICATIONS

This application claims the benefit of German Patent Applications DE 102022207735.0, filed on Jul. 27, 2022, and DE 102023206241.0, filed on Jun. 30, 2023, the contents of which are incorporated by reference in their entireties.

BACKGROUND

The disclosure relates to a method for operating a cooling chamber in a strand guide device of a continuous caster for casting a cast strand, in particular a metal strand. The disclosure further relates to the strand guide device having a cooling device with the cooling chamber.

Continuous casters are generally known in the prior art, e.g., from German patent application DE 10 2017 209 731 A1. FIG. 5 shows the continuous caster 100 disclosed there, in which a cast strand 13, which may for example be metal, is cast by a mold 40 and subsequently deflected into the horizontal by a strand guide device 10. It is also known that the cast strand, for example made of steel, which has not yet completely solidified, passes through a plurality of cooling chambers 1, 1' according to FIG. 6 within the strand guide device, in each of which the cast strand 13 is cooled by spraying with a coolant 33 which causes the formation of steam 5. The steam is at least partially saturated with the coolant and is typically sucked out laterally, i.e., transversely to the casting direction, from the respective cooling chamber 1, 1' by a suction device 20 individually assigned to each cooling chamber. For this purpose, the suction device 20 includes a suction fan 8, a suction opening 3 in a side wall of the cooling chamber 1, 1' and a suction duct 7 connecting the suction opening and the suction fan 8.

Depending on the quality of the cast steel and the width and thickness of the cast strand, different cooling strategies are used, i.e., different amounts of water are applied to the cast strand at different positions within the continuous caster. The amount of water applied locally in each case depends on the desired cooling effect, on the speed of the cast strand within the strand guide device, on the cooling water temperature and/or on the temperature of the cast strand. In lower areas of the strand guide it is often the case that only very little or even no water is applied, i.e., that there is practically no cooling. In these cases, the suction devices only suck in dry air from the cooling chambers located there. A pre-cleaning of a steam-air mixture in the respective cooling chamber cannot be realized in this way.

German patent application DE 10 2015 209 399 A1 discloses a device for removing exhaust air from the surroundings of a metal strand by a suction device. The suction device is arranged on one side of the conveying path of the cast strand. A blower is arranged opposite the suction device on the other side of the conveying path to generate an air flow for conveying the exhaust air in a blowing direction transverse to the conveying path and, if possible, into the suction device. A control device is used to set the conveying capacity of the blower and the suction device as a function of a measured speed of the metal strip. By arranging the fan opposite the suction device, the air particles in the exhaust air can be sucked off with significantly less air volume flow and therefore with significantly less energy expenditure than if the air volume flow had to be sucked in solely by the suction device. The suction device is followed by an exhaust air treatment system for cleaning the exhaust air sucked in by the suction device, in particular for filtering out foreign substances from the exhaust air.

Furthermore, German patent specification DE 10 2006 045 791 B4 discloses a method and an arrangement for reducing the discharge of pollutants in the exhaust air of a rolling mill. The method provides a condensation step, in which part of the exhaust air changes from the gas phase to the liquid phase with the formation of droplets, and a particle separation step, in which the droplets formed in the condensation step are separated. The condensation step takes place in a condenser, which is designed as a heat exchanger. With the help of an exhaust air return line, parts of the exhaust air flow can be returned to the rolling mill. Pre-cooled outside air can be supplied to the heat exchanger to promote the condensation step. The method is to be used primarily in a cold rolling mill.

SUMMARY

The disclosure is based on the object of further developing a known method for operating a cooling chamber in a strand guide device and the known strand guide device itself such that emission-relevant substances are removed from the steam-air mixture (5'). Substances that are particularly relevant to emissions are those that are harmful to people and the environment, but also to machines, and for whose proportions in the air there are often specified limit values.

This object is achieved by the method as claimed. Accordingly, the method is characterized in that the steam-air mixture is depleted of emission-relevant substances by at least one separator, in particular by condensation.

When a freshly cast strand made of metal, in particular steel, runs through the strand guide device, it is still very hot on the surface, typically around 1100° C. to 900° C. By spraying a coolant onto the cast strand, a steam-air mixture forms in the cooling chamber, which is at least partially saturated with the coolant, which evaporates immediately. In order for this steam-air mixture to not endanger people and equipment (machines) on the casting platform (work platform) arranged above the cooling chamber and within the strand guide, the steam-air mixture, which consists of a mixture of steam and sucked-in secondary air, is sucked out of (extracted from) the cooling chamber by an suction fan and guided via an extension of the suction duct and thereby discharged from the cooling chamber. The steam-air mixture is guided through at least one separator, which depletes the steam-air mixture in terms of its dirt and pollutant load, for example by condensation. As part of its function as a condenser, the separator is designed to preferably adiabatically cool the steam-air mixture and at the same time to remove moisture from it. This is achieved in that the moisture is condensed out of the sucked-in steam-air mixture by the separator. By reducing the humidity in the air, corrosion and possibly also erosion of the pipes and the exhaust fan are reduced in the entire exhaust air system. This in turn reduces the maintenance costs for the operators.

As part of the "condensing" functionality, the separator is also designed to significantly reduce the pollutant load in the steam-air mixture. Pollutants such as "dust", "fine dust" and "VOC (volatile organic substances)" accumulate during condensation on the condensed particles in the air and are discharged together with them via a waste water channel and sent for appropriate after-treatment.

If the separator is reduced to the described "condensing" functionality, it is also referred to as a condenser for simplification.

As an alternative or in addition to its "condensation" functionality, the separator preferably also has other functionalities for depleting pollutants in the steam-air mixture. The separator can be designed to implement only one, several or all of its functionalities described below one after the other or simultaneously.

The terms "depletion" and "(pre-)conditioning" of the steam-air mixture are used synonymously.

This depletion of the pollutants preferably succeeds so well that specified emission limit values can be reliably achieved.

The secondary air is sucked out of the hall surrounding the strand guide device and is generally very heavily loaded or contaminated, in particular with substances that are harmful to health.

According to a first exemplary embodiment, the separator is arranged in front of the suction opening of the suction device in the cooling chamber. This has the advantage that the condensate produced during the condensation, in particular condensed coolant, can be drained off through a waste water channel (sinter channel) within the cooling chamber. This channel exists anyway; it is therefore advantageously not necessary to provide an additional drainage channel.

Alternatively, according to a second embodiment, the separator can also be installed in the suction duct of the suction device, which connects the suction opening and a suction fan of the suction device to one another. With this arrangement of the separator, however, it is necessary to ensure that the condensate is discharged from the suction duct.

The same problem arises for a further separator which, according to a third exemplary embodiment, would optionally be installed in the suction duct in addition to the separator in front of the suction opening. The "further separator" is basically designed to implement the same functionalities as the separator.

According to a fourth exemplary embodiment, the steam-air mixture can be additionally depleted by means of attachments and built-in components before, on, or in the suction fan of the suction device. The attachments and built-in components refer to installations, for example in the form of spray nozzles and/or specially adjusted impeller blades of the suction fan, which lead to a reduction in emissions. With a medium introduced via the spray nozzles (mainly water) and specially adjusted impeller blades, the suction fan also acts as a centrifugal separator for the pollutants mentioned.

The steam-air mixture extracted from the cooling chamber is preconditioned by the separator, the further separator and/or the attachments and built-in components before it is either released into the environment via a chimney after passing through the suction fan (not preferred) or returned to the cooling chamber. In other words, the depletion of the pollutant load in the steam-air mixture according to the first to fourth exemplary embodiments is also referred to as preconditioning.

According to a fifth advantageous exemplary embodiment, the method provides that additional air is blown into the cooling chamber by a pressure fan. In this way, the efficiency of the suction device is significantly increased because significantly less suction power is now required because large quantities of the extracted steam-air mixture are supplied to the suction opening by the pressure air fan, especially if the pressure air fan is arranged opposite the suction opening of the suction device. The additionally supplied air is therefore part of the steam-air mixture in addition to the steam and the sucked-in secondary air. The additionally supplied air can either be outside air sucked in from outside the hall in which the strand guide device is operated (1st variant) and/or air sucked out of the hall (2nd variant). In the two variants, a more or less complex conditioning of the intake air before it is fed or returned to the cooling chamber may be necessary, depending in particular on its respective preload with pollutants.

A first way of conditioning the supplied air, in particular sucked-in outside air, is to change or adjust its temperature and/or its humidity in such a way that when it mixes with the steam-air mixture already in the cooling chamber, a desired target temperature and/or a desired target humidity of the resulting mixture is set.

This is relevant because the formation of condensate in the cooling chamber changes due to regional or seasonal weather differences. A significant problem here is the intake of the so-called secondary air through unavoidable inlet and outlet openings in the cooling chamber in addition to the additional air that is supplied in a controlled manner. Unlike the variably adjustable additional air, the secondary air is always sucked in due to the design. The involuntary sucked in secondary air is classified as more polluted (mainly dust) than the additional air. The secondary air is always part of the steam-air mixture in the cooling chamber. A mean cooling chamber target temperature that is as constant as possible in the range of preferably 40° C. to 60° C. and/or a relative target air humidity of over 80% would be advantageous. The target temperature of the resulting steam-air mixture can be set via the targeted inflow of a defined quantity of additional air with a suitably selected temperature. Equally, by suitably adjusting the humidity of the additional air, the desired relative target air humidity can be adjusted for the steam-air mixture that forms in the cooling chamber.

By the supply of the additional air which is cleaner than the steam-air mixture in the cooling chamber, the proportion of undesired foreign substances per unit volume of the resulting steam-air mixture in the cooling chamber can advantageously be reduced.

The conditioning of the additional air in the form of the air recirculated from the cooling chamber (3rd variant) can take place in that this is depleted by adding separating agents for removing foreign substances from the steam-air mixture.

In the cooling chamber, the steam is primarily generated by the fact that the coolant, mainly water, evaporates when it is applied to the cast strand while it is still hot. In addition to the coolant, residues of mold powder and lubricants, e.g., oils and greases, which are required for the operation of certain parts of the system, e.g., for the segment rollers, enter into the steam-air mixture. As a result of contact with the hot cast strand and the associated evaporation process, undesirable parts of the substances mentioned can be found in the steam-air mixture. By adding separating agents, so-called adsorbents, these substances can be separated again from the steam-air mixture and optionally collected separately. A similar conditioning can also be carried out for the additional air extracted from the hall.

The coolant that is used as part of said secondary cooling in the cooling chambers of the strand guide device for cooling the cast strand typically consists of 100% water.

By providing for the targeted blowing of the additional air 14 into the cooling chamber by a pressure fan, the dimensioning of the entire suction device, i.e., the suction fan, the suction duct, and the suction opening, can be smaller. This applies because the pressure air fan feeds large amounts of the steam-air mixture to the suction opening, which previously, i.e., without the presence of the pressure fan, would have to be sucked in by the suction device alone. The reduction in size of the suction device also has the advantage that the volume flow of the steam-air mixture at the outlet of the suction device and thus the necessary power consumption of the suction device is reduced.

Reducing the dimensions of the suction device also has the advantage that installation space can be saved and that installation in tight spaces is made easier. The reduced volume flow in the cooling chamber and the suction device favors the installation of the separator in front of the suction opening, because the separator can be operated more effectively at low air speeds, i.e., with less energy consumption. Furthermore, the reduced volume flow from the cooling chamber also has the advantageous effect that less secondary air is sucked in.

According to a sixth exemplary embodiment, part of the extracted and pre-condensed steam-air mixture at the outlet of the suction device can advantageously be fed back to the cooling chamber via a first partial air return line. This may be referred to as endless filtration. The residual steam-air mixture released to the environment via leaks in pipes and ducts and/or ultimately via the chimney (not favored) is reduced accordingly.

The measures described so far for depleting or cleaning the steam-air mixture, i.e., the various options for preconditioning and the supply of additional air according to the 1st or 2nd embodiment described above, are often not sufficient to meet new, even stricter limits for emissions into the ambient air.

Therefore, according to a seventh embodiment of the cooling chamber, the steam-air mixture extracted from the cooling chamber is not discharged to the environment via the extended exhaust air duct and the chimney. Rather, a variably adjustable first portion is fed back via the first partial air return line into the cooling chamber and a variably adjustable second portion is supplied to a conditioning device. In the conditioning device, the steam-air mixture is conditioned or prepared for re-use within the strand guide device, in particular in its cooling chamber, i.e., it is primarily further cleaned of pollutants. The processing is carried out in particular by cooling, dehumidifying and/or cleaning the incoming pre-conditioned steam-air mixture. The processing advantageously goes so far that the conditioned steam-air mixture at the outlet of the conditioning device even satisfies the latest strict limit values for air pollution control. The steam-air mixture conditioned in this way is intended and suitable for being fed back largely or completely to the strand guide device, in particular its cooling chamber, as additional air (3rd variant), so that an almost closed air circuit is created, or returned into the hall surrounding the strand guide device. The operation of the strand guide device can thus advantageously be implemented at least without any environmentally harmful emissions via the chimney into the ambient air.

Since moist exhaust air no longer has to be fed to the outside air via the chimney, water no longer has to be replaced, which results in significant water savings in the corresponding cooling circuits of the secondary cooling. Furthermore, all emissions are eliminated, so that no more harmful emissions are generated by the strand guide device.

The partial air quantities (portions) are set by distribution devices, e.g., distribution flaps. The proportions of the individual partial air quantities can each be between 0% and 100%, with the sum of the individual partial air quantities per distribution device being 100%.

DETAILED DESCRIPTION

The invention is described in detail below with reference to FIGS. 1 to 4 in the form of exemplary embodiments. The same technical elements are denoted by the same reference symbols in all figures.

Figure 1:
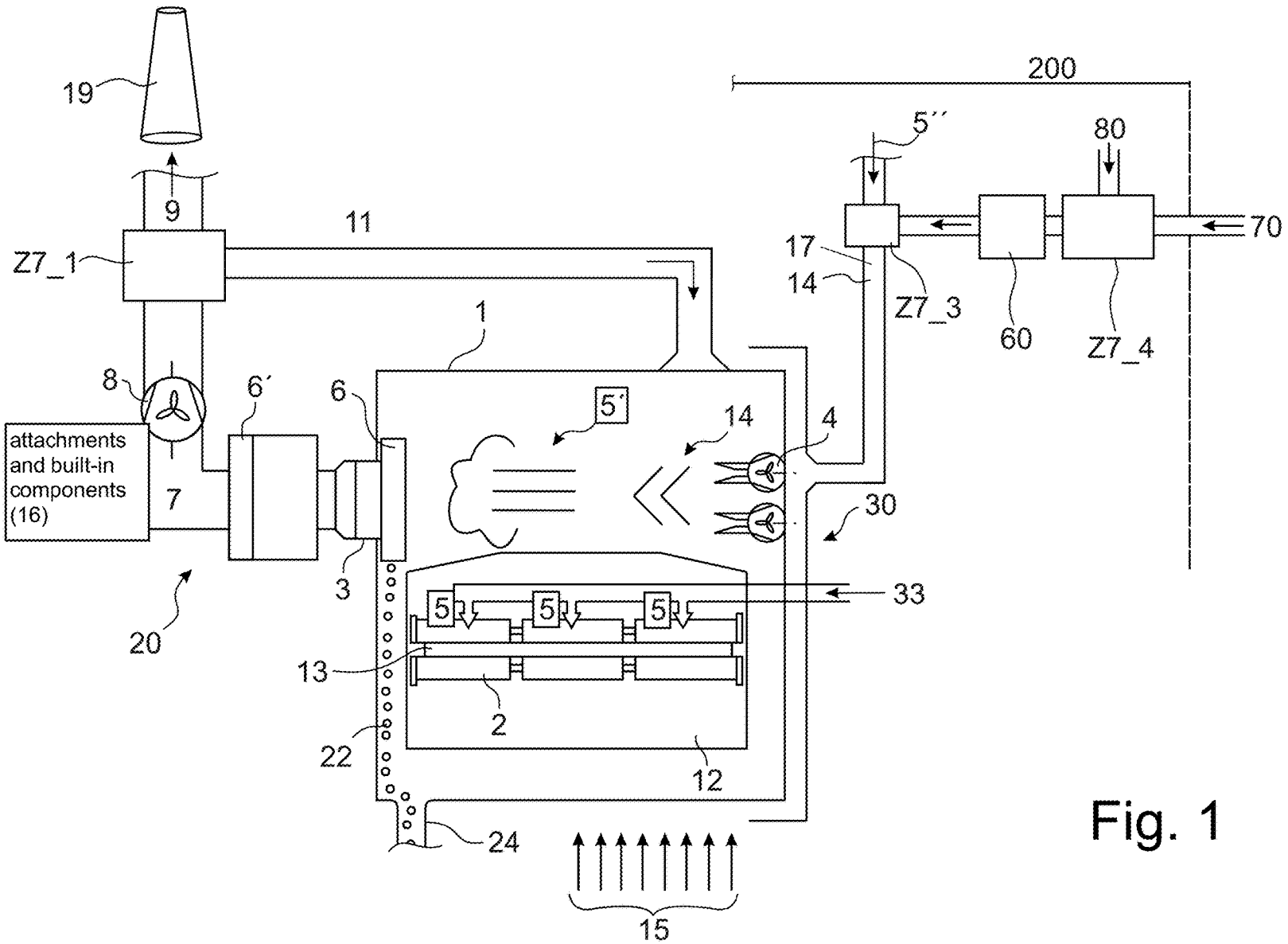
FIG. 1 shows a cooling chamber with associated suction device according to a first to sixth exemplary embodiment.

FIG. 1 shows a cross section through a cooling chamber 1 of a strand guide device 10 of a continuous caster. FIG. 1 shows in particular a segment 12 of the strand guide device 10 with strand guide rollers 2 in cross section, between which the cast strand 13 is guided. The cooling chamber 1 forms a housing for the strand guide device 1, in particular the segments 12. It has undesired openings through which secondary air 15 in the form of ambient air or indoor air is inevitably sucked in as well. FIG. 1 shows the cooling chamber 1 with a plurality of exemplary embodiments, as will be described further below.

On its way through the strand guide device, more precisely through its segments 12, the cast strand 13 is cooled in the cooling chamber 1 by spraying with a coolant 33. The steam 5 produced by the evaporation of the coolant together with the inevitably sucked in secondary air 15 form a steam-air mixture 5'. This is at least partially saturated with the coolant 33.

It can also be seen in FIG. 1 that the cooling chamber 1 is assigned a suction device 20 for sucking off the steam-air mixture 5' from the cooling chamber 1. The suction device 20 comprises a suction fan 8 and a suction duct 7 which connects a suction opening 3 in the cooling chamber 1 to the suction fan 8. The continuation of the suction duct 7 downstream of the suction fan 8 is denoted by the reference number 9. The continuation of the suction duct can direct the suctioned-off steam-air mixture 5' to a chimney 19. However, this variant is not favored.

Figure 2:
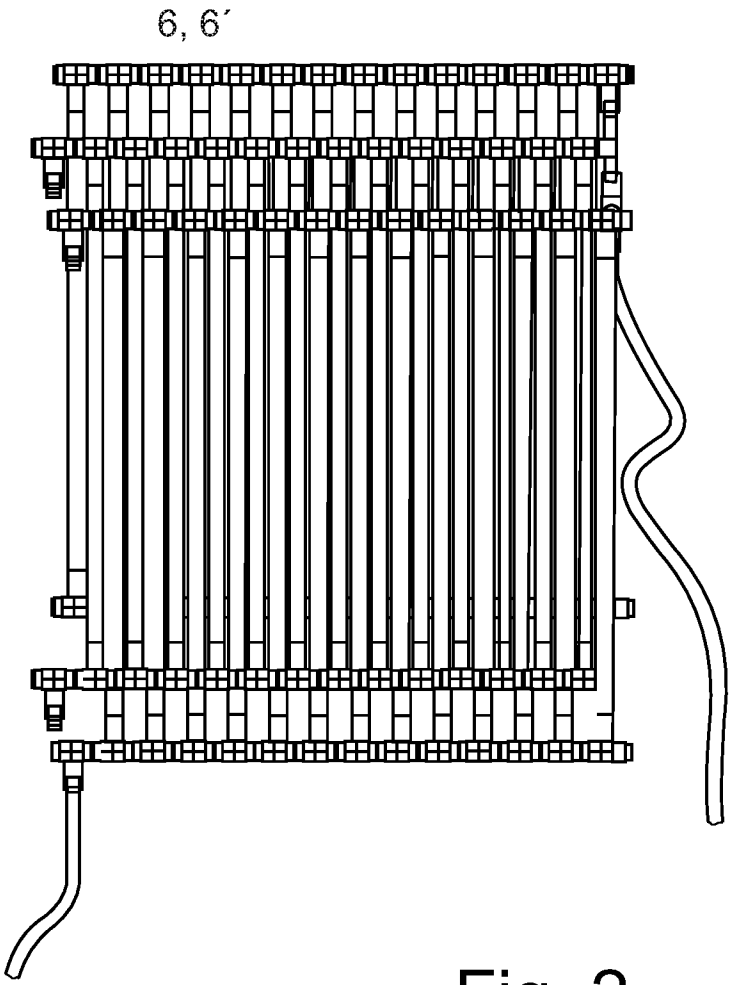
FIG. 2 shows different versions of a separator.
Figure 2:
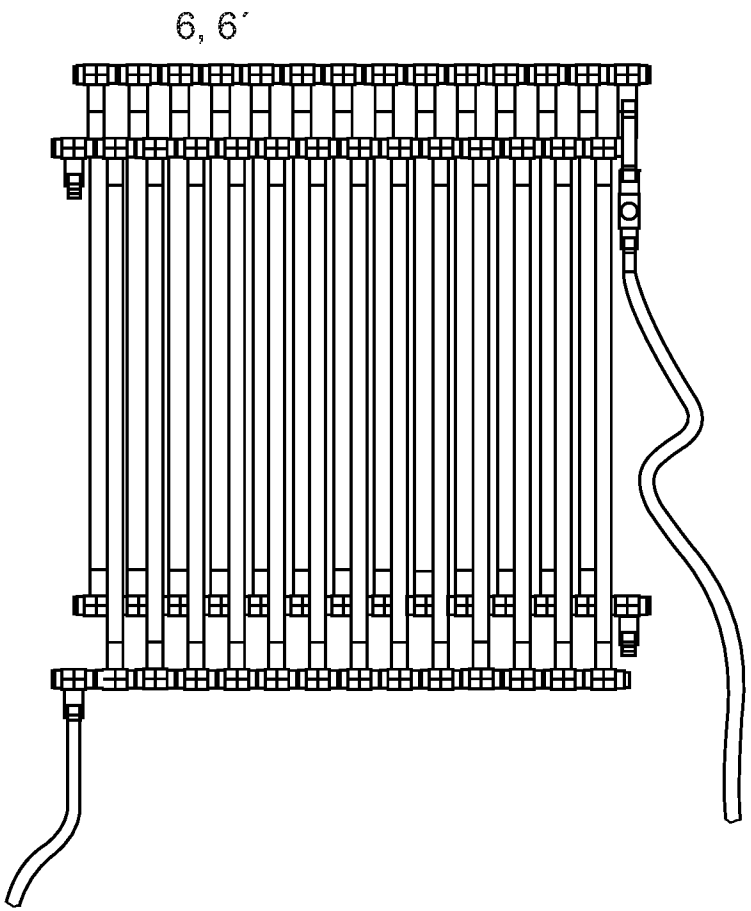

In contrast to the prior art, at least one preferably multilayer separator 6, 6' is provided, as shown in FIG. 2, left and right illustration, for example with 2 and 3 layers, also called packages. The separator 6 and possibly a further separator 6' are designed to implement at least one of the following functions and to treat the steam-air mixture 5' accordingly:

Condensation: Condensation describes the functionality with which the aerosols, fine dust aerosols and water vapor in the exhaust air, i.e., in the extracted steam-air mixture 5', are separated from the steam-air mixture 5' by active cooling (with cooling water). This can be referred to as physical separation. As part of the condensation function, the steam-air mixture is preferably cooled adiabatically and at the same time moisture is removed from it. This is achieved in that the moisture is condensed out of the sucked-in steam-air mixture 5' by the separator 6,6'.

Droplet separation: This function of the separator is implemented in that the sucked-in steam-air mixture 5' is deflected at a minimum speed. Due to their inertia, any heavy droplets present in the mixture 5' cannot follow the deflection of the air. Instead, they take a trajectory that deviates from the deflection. This effect can be utilized in order to enable a first separation of the coarse droplets with dirt and/or pollutants deposited on them from the mixture 5'. The function can be described as mechanical separation.

Air rectification: The rectification of the sucked-in steam-air mixture 5' within the separator can be optimally adjusted by the specific arrangement of the separator packs according to FIG. 2 and their distance from one another. Uniform flow velocities are produced over the entire suction area without significantly changing the penetration depth. In this way, the effective suction area can even be expanded beyond the extent of the actual opening of the extraction point. Tests have shown that the suction area can be expanded by up to 30%.

Self-cleaning: The functionality of the self-cleaning of the separator is implemented in such a way that drops with accumulated dirt and/or pollutant particles are safely discharged with the draining condensate water on the smooth pipes of the separator. Due to the permanently moist pipes, the risk of caking is almost completely eliminated.

Individual or all of the functionalities mentioned can take place in sequence or simultaneously. If the separator 6 and/or the further separator 6' is designed to implement two or more of the functions mentioned, they are also referred to as multi-function separators.

As shown in FIG. 1, according to a first exemplary embodiment, the separator 6 is advantageously arranged in front of the suction opening 3 of the suction device 20 in the cooling chamber. This is advantageous because the condensate 22 emerging in the separator 6, in particular the condensed coolant, can then be discharged through a waste water channel 24 or a sinter channel within the cooling chamber 1. Alternatively, according to a second exemplary embodiment, the separator can also be arranged in the direction of flow of the steam-air mixture 5' between the suction opening 3 and the suction fan 8 in the suction duct 7 or also in the exhaust air duct 9 that continues behind the suction fan in the direction of flow.

If, according to a third exemplary embodiment, not only a single separator 6 but also a further separator 6' is provided, this can (likewise) be arranged in the suction duct 7. In cases where the separator 6 and/or the further separator 6' are arranged in the suction duct 7, there must be a possibility in the suction channel 7 for collecting and discharging the condensate 22 generated there.

The cooling water required for the operation of the separator can be taken from the secondary cooling water of the strand guide device 10 and does not have to be specially conditioned. In addition, the water, which is separated via the separator 6, 6' is returned to the cooling circuit and is not fed to the environment via the chimney 19 as a steam-air mixture. This leads to an additional saving of water.

Optionally, the depletion of the steam-air mixture 5'—except by the separator 6, 6'—can, according to a fourth embodiment, additionally be effected by means of attachments and built-in components 16, such as spray nozzles, which are arranged in front of, in, on or—in the direction of flow—behind the suction fan 8. They offer an additional possibility of reducing or preconditioning the pollutant content of the steam-air mixture 5' before it is passed on into the exhaust air chimney 19, into a first partial air return line 11 or into a conditioning device Z, see FIG. 3.

According to a fifth exemplary embodiment, additional air can optionally be blown into the cooling chamber 1 by a pressure fan 4. The pressure fan 4 is preferably arranged in the cooling chamber 1 opposite the suction opening 3 of the suction device 20, as shown in FIG. 1. The additionally supplied air 14 mixes in the cooling chamber 1 with the steam-air mixture 5' already present there.

The additional air 14 can be generated by conditioning the steam-air mixture 5' sucked out of the cooling chamber 1 with the conditioning device Z, by conditioning indoor air 80 sucked out of the hall 200 with a further conditioning device 60 and/or by preferably conditioning outside air 70, also with the conditioning device 60, the outside air being sucked in from outside the hall 200.

The type and scope of the conditioning depend on the type and quality of the air drawn in. The proportions of the three possible components mentioned in the additional air 14 are adjusted via a third distribution device Z7_3 and/or a fourth distribution device Z7_4, each designed in the form of a distribution flap, for example. By the distribution device Z7_4, for example, the quantitative proportions of the indoor air 80 and the intake outside air 70 in the additional air 14 can be variably preset. These proportions are depleted to the extent necessary by the further conditioning device 60. With the help of the distribution device Z7_3, for example, the proportions of the conditioned steam-air mixture 5" and the air at the outlet of the further conditioning device Z7_4 in the additional air 14 can be variably adjusted. The individual proportions of the three possible components in the total amount of additional air 14 supplied is between 0% and 100% each, and in sum always 100%. The arrangement of the distribution devices Z7_3 and Z7_4 and the further conditioning device 60 shown in FIG. 1 are merely exemplary. Other interconnections of these devices or use of fewer than all of the devices are also conceivable, depending on which of the possible components or proportions the additional air 14 is supposed to contain. The distribution devices Z7_3 and Z7_4 and the further conditioning device 60 can also be omitted completely if only the conditioned steam-air mixture 5" is to be fed into the cooling chamber 1 as additional air 14 or no additional air 14 is used at all.

Catch grates can be provided as a system protection in front of or in the separator 6 or in the suction duct 7 in order to protect subsequent system parts in the direction of flow from undesired external influences due to coarse foreign objects that have been sucked in.

According to a sixth exemplary embodiment, a first distribution device Z7_1, for example in the form of a first distribution flap, is located in the extended exhaust air duct 9, preferably at the outlet of the suction fan 8, before the first partial air return line 11. The first distribution device Z7_1 serves to variably divide the preconditioned steam-air mixture 5' into a first and a second portion. The first portion of the preconditioned steam-air mixture is fed back into the cooling chamber 1 via the first partial air return line 11.

The second portion of the steam-air mixture is routed past the first partial air return line 11 and is either discharged via the chimney 19 into the area surrounding the strand guide device 10 (not favored) or, according to a seventh exemplary embodiment, supplied to the conditioning device Z via the extended exhaust air duct 9.

Figure 3:
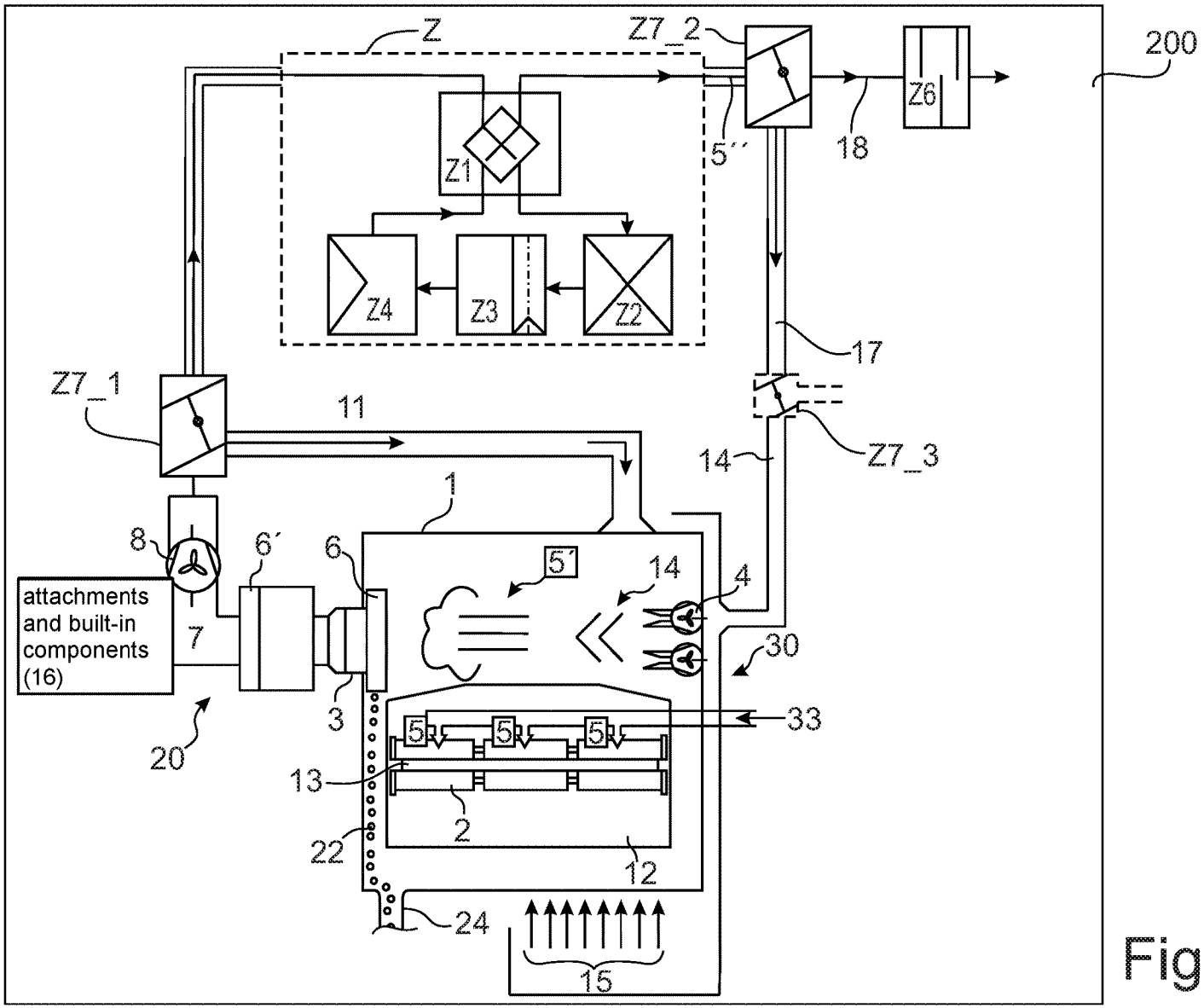
FIG. 3 shows the cooling chamber according to a seventh embodiment with a conditioning device.

FIG. 3 shows the cooling chamber 1 according to the seventh embodiment. This relates essentially to the treatment of the steam-air mixture 5' which has been sucked out of the cooling chamber 1 and—as described above—preferably already preconditioned.

In the conditioning device Z, the second portion of the steam-air mixture preferably first runs through a cooler Z2 for the purpose of cooling. As a result of the cooling, the steam-air mixture 5' is further preconditioned for a subsequent removal of (air) moisture. A dehumidifier Z3 is connected downstream of the cooler Z2 for dehumidifying the cooled steam-air mixture by (out) condensing. The dehumidifier is followed by a filter Z4 for cleaning the steam-air mixture and a heat exchanger Z1 for reheating the dehumidified and cooled steam-air mixture, preferably by extracting heat from the supplied second portion of the extracted steam-air mixture at the inlet of the conditioning device Z. As a result, the incoming steam-air mixture is advantageously already pre-cooled before it reaches the cooler Z2. Finally, the conditioning device Z outputs a conditioned steam-air mixture 5". The conditioning device Z does not necessarily have to have all of the components mentioned, such as the cooler Z2, the dehumidifier Z3, the filter Z4 and the heat exchanger Z1. Depending on the configuration, the conditioning device Z can also only contain individual components.

The steam-air mixture 5" conditioned in this way is routed to a second distribution device Z7_2. This second distribution device, for example in the form of a second distribution flap, is used for variably dividing the conditioned steam-air mixture 5" into a first and a second portion. The first portion is fed back into the cooling chamber 1 via a second partial air return line 17 as the additionally supplied air 14 or a part thereof. Optionally, this takes place with the addition of indoor air 80 or outside air 70, as already described above with reference to FIG. 1 and as indicated by the third distribution device Z7_3 drawn in dashed lines in FIG. 3. The second portion of the conditioned steam-air mixture 5" is conducted via an exit line 18 into the hall 200 surrounding the strand guide device 10 or to the outside of the hall 200.

A damper Z6 is preferably connected downstream of the second distribution device Z7_2 to dampen the flow noise of the second portion of the conditioned steam-air mixture 5" in the outlet line 18.

Figure 4:
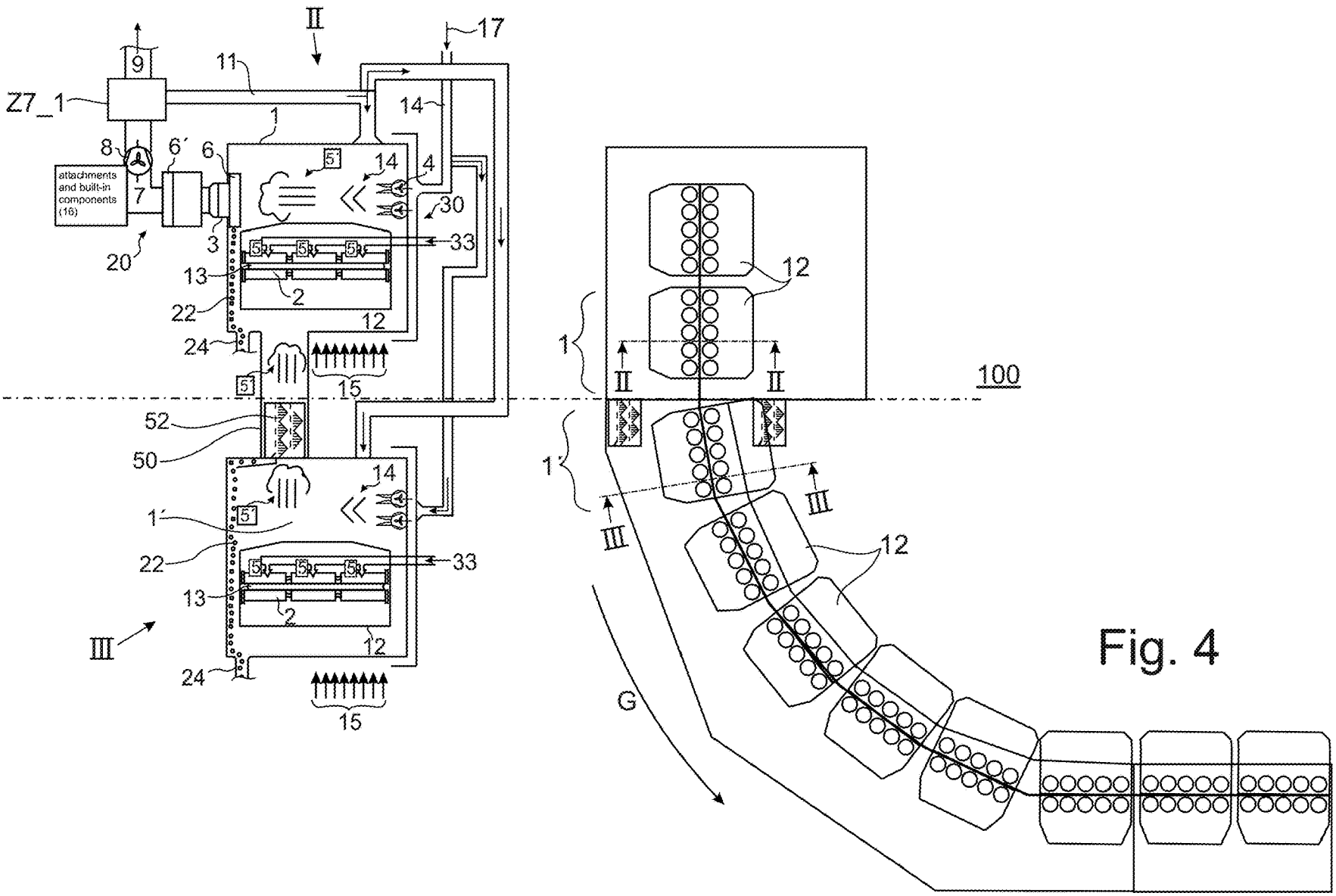
FIG. 4 shows a strand guide device with two cooling chambers arranged one behind the other according to an eighth exemplary embodiment.
Figure 5:
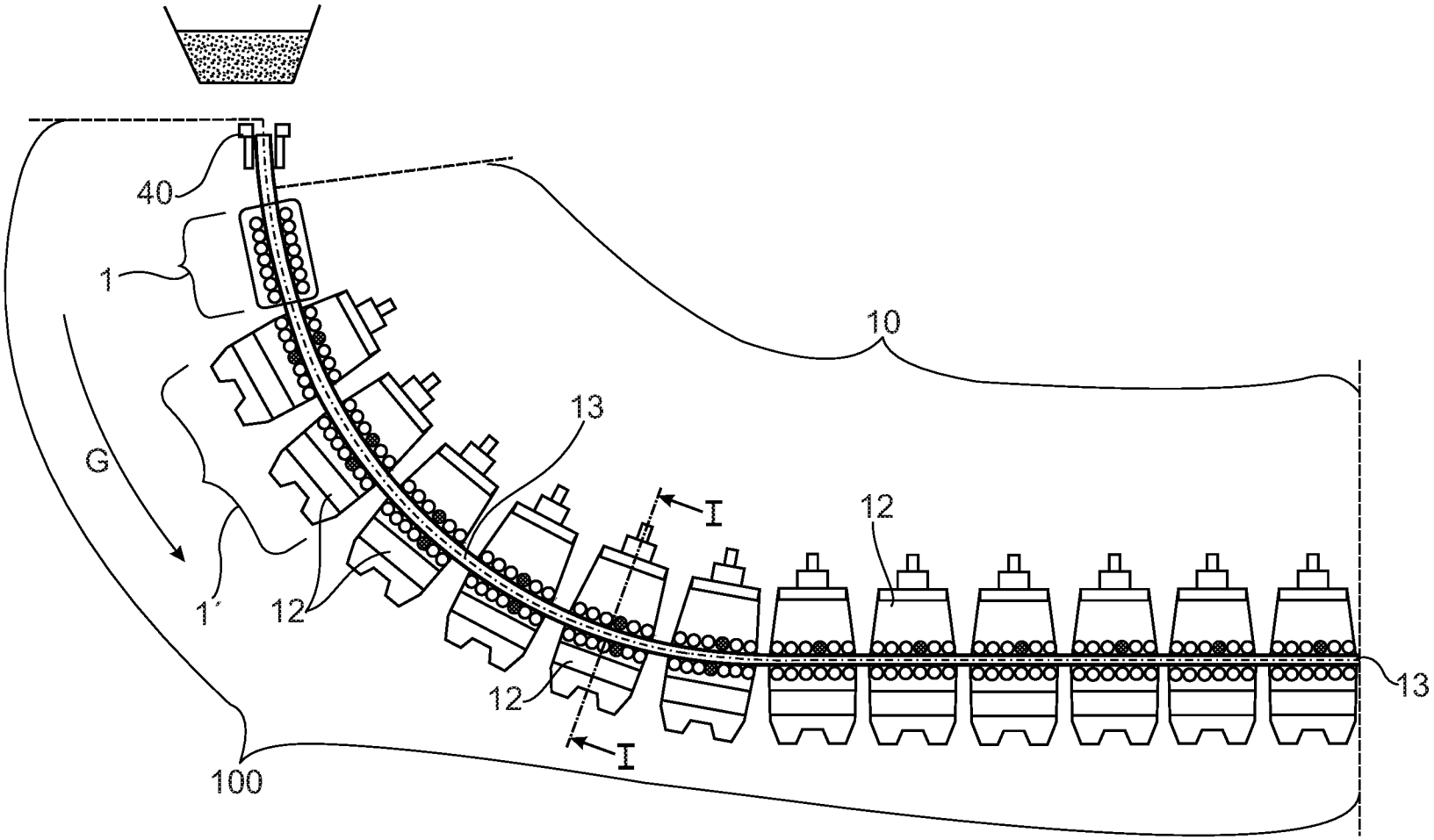
Fig. 5 Prior Art
FIG. 5 shows a strand guide device according to the prior art.
Figure 6:
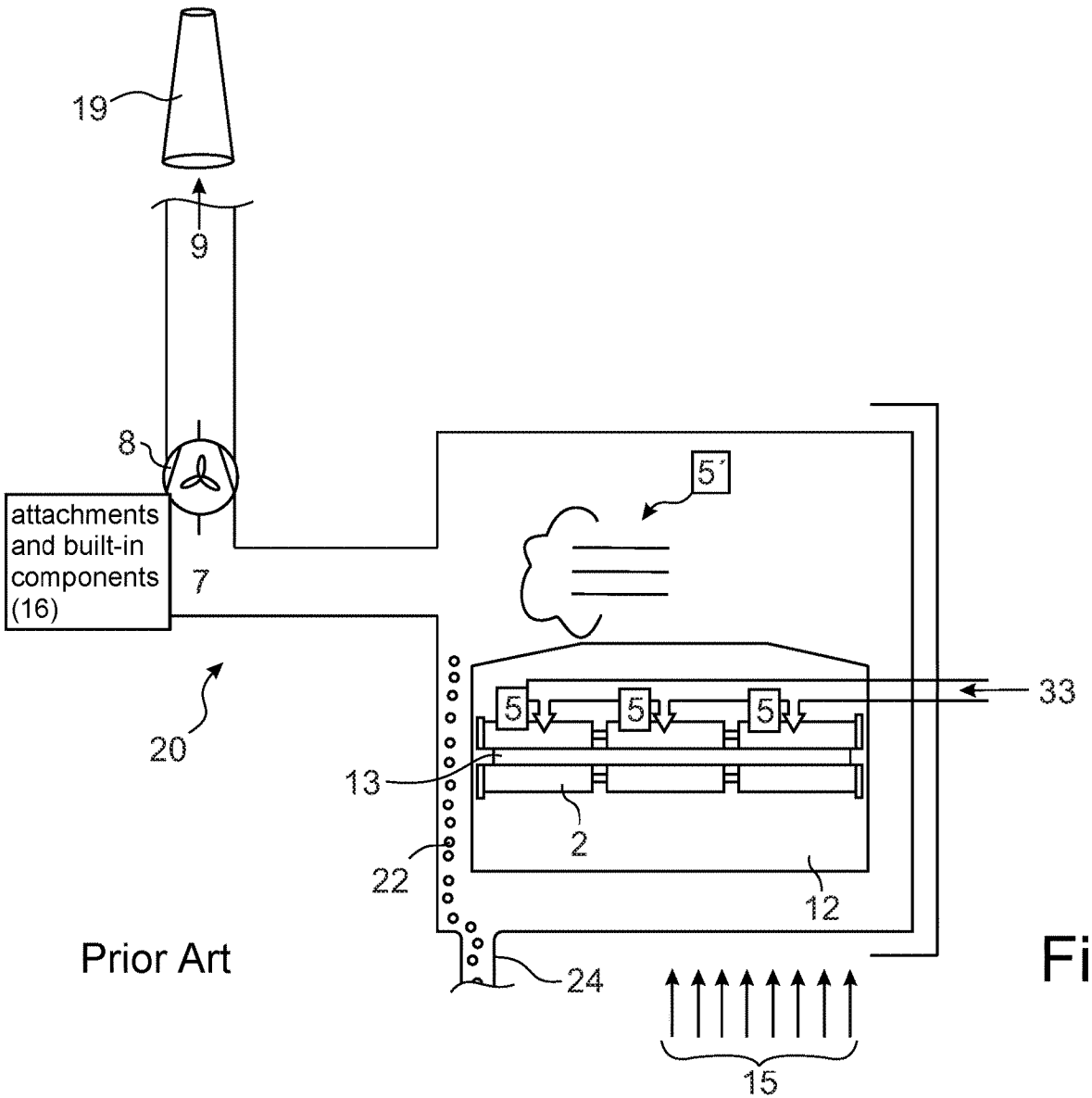
Fig. 6 Prior Art
FIG. 6 shows a cooling chamber with associated suction device according to the prior art.

FIG. 4 illustrates an eighth embodiment. Accordingly, in the strand guide device a plurality of cooling chambers 1, 1' are arranged one behind the other, through which the cast strand 13 cast in the mold 40 passes in succession. Two adjacent cooling chambers 1, 1' are each connected to one another via an (exhaust) air duct 50, which extends in the casting direction G, and thus form an overall system that communicates with one another in terms of air flow. Only the first cooling chamber 1, i.e., the cooling chamber immediately downstream of the mold 40, is connected to a lateral suction device 20. In contrast to the prior art, the cooling chambers 1' arranged downstream in the casting direction G no longer each have their own lateral suction device. Instead, the exhaust air, i.e., the steam-air mixture, is also sucked out of the downstream cooling chambers 1' counter to the casting direction G through said air duct 50 into the first, uppermost cooling chamber 1, ultimately effected by the suction device 20 assigned to the first cooling chamber. The extracted exhaust air passes through an air washer 52 within the air ducts 50 before it reaches the first uppermost cooling chamber 1 and is extracted there by the suction device 20. Since the exhaust air from a cooling chamber first passes through the air washer 52, it is pre-cleaned before it reaches the first or uppermost cooling chamber.

The air washers 52 are operated with water. The water required for this can be taken from the secondary cooling water circuit, with which the cast strand 13 is (secondarily) cooled in the upper cooling chambers. This is possible because, in particular in the cooling chambers arranged further down in the casting direction G, as mentioned, a particularly large cooling capacity is no longer required; the (secondary) cooling water available there can therefore be used for the air washers there to clean the exhaust air.

The air ducts 50 are quasi assigned to the cooling chambers 1'; in this respect, the cleaning of the exhaust air takes place by the air washer 52, so to speak, within the respectively downstream cooling chambers 1'. The cooling water used for the operation of the air washer 52 from the secondary cooling water circuit does not have to be specially conditioned beforehand. After it has passed through the air washer 52, it can be returned to the secondary cooling water circuit, and it does not have to be processed separately for this either. This leads to an additional saving of water. Overall, the use of the air washer 52 brings about a significant pre-cleaning, i.e., a reduction in the pollutant content in the exhaust air from the respective cooling chamber.

REFERENCE SIGN LIST

1 cooling chamber
1' cooling chamber
2 strand guide rollers
3 suction opening
4 pressure fan
5 steam
5' steam-air mixture
5" conditioned steam-air mixture
6 separator
6' further separator
7 suction duct
8 suction fan
9 extended exhaust air duct (chimney)
10 strand guide device
11 first partial air return line
12 segment of the strand guide device
13 casting strand
14 additional air
15 secondary air
16 attachments and/or build-in components
17 second partial air return line
18 output line
19 chimney
20 suction device
22 condensate
24 waste water channel
30 cooling device
33 coolant
40 mold
50 air duct
52 air washer
60 additional conditioning device
70 outside air
80 indoor air
100 continuous caster
200 hall
G casting direction
Z conditioning device
Z1 heat exchanger
Z2 cooler
Z3 dehumidifier
Z4 filter
Z6 damper Z7_1 exhaust air distribution flap (first distribution device)

Z7_2 return distribution flap (second distribution device)

Z7_3 third distribution device

Z7_4 fourth distribution device

What is claimed is:

1. A method for operating a continuous caster (100), comprising:

deflecting a cast strand (13) after it exits a mold (40) of the continuous caster (100) into a horizontal orientation in a strand guide device (10) arranged downstream of the mold;

cooling the cast strand (13) as it passes through a cooling chamber (1) inside the strand guide device (10) by spraying a coolant (33) onto the cast strand (13) causing steam (5) to form inside the cooling chamber (1), wherein the steam (5) forms, at least together with sucked-in secondary air, a steam-air mixture (5') which is at least partially saturated with the coolant (33); and extracting the steam-air mixture (5') from the cooling chamber (1) using a suction device (20) which comprises a suction fan (8), a suction opening (3) opening into the cooling chamber (1), and a suction duct (7) connecting the suction opening (3) and the suction fan (8); and depleting the steam-air mixture (5') by a separator (6) arranged inside the cooling chamber (1) in front of the suction opening (3) of the suction device (20); and draining condensed steam-air mixture (5') from the separator (6) into a waste water channel (24) inside the cooling chamber (1).

2. The method according to claim 1, wherein depleting the steam-air mixture (5') within the separator (6) takes place by condensation and/or droplet separation in connection with air rectification.

3. The method according to claim 1, wherein depleting the steam-air mixture (5') also takes place before, on, or in the suction fan (8) of the suction device (20) by attachments and/or built-in components (16) by which a medium is introduced into the extracted steam-air mixture (5').

4. The method according to claim 1, wherein the steam-air mixture (5') has a higher relative humidity than air supplied to the cooling chamber.

5. A method for operating a continuous caster (100), comprising:

deflecting a cast strand (13) after it exits a mold (40) of the continuous caster (100) into a horizontal orientation in a strand guide device (10) arranged downstream of the mold;

cooling the cast strand (13) as it passes through a cooling chamber (1) inside the strand guide device (10) by spraying a coolant (33) onto the cast strand (13) causing steam (5) to form inside the cooling chamber (1), wherein the steam (5) forms, at least together with sucked-in secondary air, a steam-air mixture (5') which is at least partially saturated with the coolant (33); and extracting the steam-air mixture (5') from the cooling chamber (1) using a suction device (20) which comprises a suction fan (8), a suction opening (3) opening into the cooling chamber (1), and a suction duct (7) connecting the suction opening (3) and the suction fan (8); and depleting the steam-air mixture (5') by a separator (6) arranged in the suction duct (7) of the suction device (20) and by a further separator (6').

6. A method for operating a continuous caster (100), comprising:

deflecting a cast strand (13) after it exits a mold (40) of the continuous caster (100) into a horizontal orientation in a strand guide device (10) arranged downstream of the mold;

cooling the cast strand (13) as it passes through a cooling chamber (1) inside the strand guide device (10) by spraying a coolant (33) onto the cast strand (13) causing steam (5) to form inside the cooling chamber (1), wherein the steam (5) forms, at least together with sucked-in secondary air, a steam-air mixture (5') which is at least partially saturated with the coolant (33); and extracting the steam-air mixture (5') from the cooling chamber (1) using a suction device (20) which comprises a suction fan (8), a suction opening (3) opening into the cooling chamber (1), and a suction duct (7) connecting the suction opening (3) and the suction fan (8); and depleting the steam-air mixture (5') by a separator (6), wherein preconditioned steam-air mixture (5') after passing the suction fan to an extent of a first portion is returned to the cooling chamber (1); and/or to an extent of a second portion is supplied to a conditioning device (Z) to there be further conditioned.

7. A method for operating a continuous caster (100), comprising:

deflecting a cast strand (13) after it exits a mold (40) of the continuous caster (100) into a horizontal orientation in a strand guide device (10) arranged downstream of the mold;

cooling the cast strand (13) as it passes through a cooling chamber (1) inside the strand guide device (10) by spraying a coolant (33) onto the cast strand (13) causing steam (5) to form inside the cooling chamber (1), wherein the steam (5) forms, at least together with sucked-in secondary air, a steam-air mixture (5') which is at least partially saturated with the coolant (33); and extracting the steam-air mixture (5') from the cooling chamber (1) using a suction device (20) which comprises a suction fan (8), a suction opening (3) opening into the cooling chamber (1), and a suction duct (7) connecting the suction opening (3) and the suction fan (8); and depleting the steam-air mixture (5') by a separator (6); and blowing additional air (14) into the cooling chamber (1) by a pressure fan (4), the pressure fan (4) being installed opposite the suction opening (3) of the suction device (20).

8. The method according to claim 7, wherein the additional air is outside air (70) sucked in from outside a hall (200), interior air (80) sucked in from the hall (200) and/or steam-air mixture (5') extracted out of the cooling chamber (1, 1') after it has been preconditioned; and wherein the additional air (14) is generated by extracted and preconditioned steam-air mixture (5') being conditioned by a conditioning device (Z), and/or by the outside air (70) or the interior air (80) being conditioned by an additional conditioning device (60) before being blown into the cooling chamber (1), the conditioning comprising at least one of cooling and/or heating of the additional air (14), increasing humidity of the additional air (14) by partial air recirculation or media injection, cleaning the additional air (14); and depleting pollutants of the additional air (14) by admixture of adsorbents.

9. The method according to claim 8, wherein the preconditioned steam-air mixture (5') is cooled, dehumidified and/or cleaned in the conditioning device (Z).

10. A strand guide device (10), comprising:

strand guide rollers (2) for guiding a cast strand (13) that has been cast by a mold (40) arranged upstream of the strand guiding device (10);

a cooling device (30) with a cooling chamber (1) for cooling the cast strand (13) as it runs through the cooling chamber (1) by spraying a coolant (33) onto the cast strand (13) thereby forming a steam-air mixture (5') within the cooling chamber (1), wherein the steam-air mixture (5') is at least partially saturated with the coolant (33);

a suction device (20), which includes a suction fan (8), a suction opening (3) in the cooling chamber (1), and a suction duct (7) connecting the suction opening (3) to the suction fan (8), for extracting the steam-air mixture (5') from the cooling chamber (1); and a separator (6, 6') for depleting pollutants (33) from the extracted steam-air mixture (5'), wherein the separator (6) is arranged in front of the suction opening (3) of the suction device (20) in the cooling chamber (1, 1') for condensing the coolant (33) within the cooling chamber (1, 1'), and wherein the cooling chamber (1) has a waste water channel (24) for draining off the condensate (22).

11. The strand guide device (10) according to claim 10, wherein the separator (6) is arranged in the suction duct (7) of the suction device (20).

12. The strand guide device (10) according to claim 10, further comprising a further separator (6') arranged in the suction duct (7) of the suction device (20).

13. The strand guide device according to claim 10, further comprising attachments and/or built-in components (16) arranged in front of, on, in or behind the suction fan (8) for introducing a separating agent or absorbents into the steam-air mixture (5') to deplete it of dirt and/or pollutants.

14. A strand guide device (10), comprising:

strand guide rollers (2) for guiding a cast strand (13) that has been cast by a mold (40) arranged upstream of the strand guiding device (10);

a cooling device (30) with a cooling chamber (1) for cooling the cast strand (13) as it runs through the cooling chamber (1) by spraying a coolant (33) onto the cast strand (13) thereby forming a steam-air mixture (5') within the cooling chamber (1), wherein the steam-air mixture (5') is at least partially saturated with the coolant (33);

a suction device (20), which includes a suction fan (8), a suction opening (3) in the cooling chamber (1), and a suction duct (7) connecting the suction opening (3) to the suction fan (8), for extracting the steam-air mixture (5') from the cooling chamber (1);

a separator (6, 6') for depleting pollutants (33) from the extracted steam-air mixture (5'); and a pressure fan (4) for blowing additional air (14) into the cooling chamber (1), the pressure fan (4) being arranged opposite the suction opening (3) of the suction device (20) in the cooling chamber (1).

15. A strand guide device (10), comprising:

strand guide rollers (2) for guiding a cast strand (13) that has been cast by a mold (40) arranged upstream of the strand guiding device (10);

a cooling device (30) with a cooling chamber (1) for cooling the cast strand (13) as it runs through the cooling chamber (1) by spraying a coolant (33) onto the cast strand (13) thereby forming a steam-air mixture (5') within the cooling chamber (1), wherein the steam-air mixture (5') is at least partially saturated with the coolant (33);

a suction device (20), which includes a suction fan (8), a suction opening (3) in the cooling chamber (1), and a suction duct (7) connecting the suction opening (3) to the suction fan (8), for extracting the steam-air mixture (5') from the cooling chamber (1);

a separator (6, 6') for depleting pollutants (33) from the extracted steam-air mixture (5'); and a first partial air return line (11) for returning at least a first portion of preconditioned steam-air mixture (5') from an extended suction duct (9) into the cooling chamber (1).

16. The strand guide device (10) according to claim 15, further comprising a first distribution device (Z7_1), in form of a first distribution flap, in an extended exhaust air duct (9) at an outlet of the suction fan (8), for variable adjustment of the first portion of depleted or preconditioned steam-air mixture (5'), which is routed back into the cooling chamber (1) preconditioned via the first partial air return line (11), and a second portion of the depleted steam-air mixture which is routed past the first partial air return line (11).

17. The strand guide device (10) according to claim 16, further comprising a conditioning device (Z) downstream of the first distribution device (Z7_1) for receiving and conditioning a second portion of extracted and preconditioned steam-air mixture, wherein the conditioning device (Z) includes at least one of a cooler (Z2) for cooling the second portion of the extracted steam-air mixture;

a dehumidifier (Z3) for dehumidifying the cooled steam-air mixture by condensing;

a filter (Z4) for cleaning the steam-air mixture; or a heat exchanger (Z1) for reheating the dehumidified and/or cooled steam-air mixture by extracting heat from the supplied second portion of the extracted steam-air mixture at an inlet of the conditioning device (Z) and for outputting a conditioned steam air mixture (5'').

18. The strand guide device (10) according to claim 17, further comprising a second distribution device (Z7_2) downstream of the conditioning device (Z) for variably adjusting a first and a second portion of conditioned steam-air mixture (5") at the outlet of the conditioning device (Z);

a second partial air return line (17) for directing the first portion of the conditioned steam-air mixture (5") back into the cooling chamber (1); and an outlet line (18) for conducting the second portion of the conditioned steam-air mixture (5") into a hall (200) surrounding the strand guide device (100) or outside the hall (200) surrounding the strand guide device.

19. The strand guide device according to claim 18, further comprising a damper (Z6) connected downstream of the second distribution device (Z7_2) for damping a flow noise of the second portion of the conditioned steam-air mixture in the outlet line (18).

20. The strand guide device according to claim 18, further comprising a fourth distribution device (Z7_4) for generating an air mixture at its outlet from received hall air (80) and outside air (70) in a predetermined mixing ratio;

an additional conditioning device (60) for conditioning the air mixture to reduce its dirt and pollutant content; and a third distribution device (Z7_3) arranged in the second partial air return line (17) for mixing the first portion of the conditioned steam-air mixture (5") with the conditioned air mixture in a predetermined mixing ratio to generate the additional air (14) supplied into the cooling chamber (1, 1').

21. A strand guide device (10), comprising:

strand guide rollers (2) for guiding a cast strand (13) that has been cast by a mold (40) arranged upstream of the strand guiding device (10);

a cooling device (30) with a cooling chamber (1) for cooling the cast strand (13) as it runs through the cooling chamber (1) by spraying a coolant (33) onto the cast strand (13) thereby forming a steam-air mixture (5') within the cooling chamber (1), wherein the steam-air mixture (5') is at least partially saturated with the coolant (33);

a suction device (20), which includes a suction fan (8), a suction opening (3) in the cooling chamber (1), and a suction duct (7) connecting the suction opening (3) to the suction fan (8), for extracting the steam-air mixture (5') from the cooling chamber (1); and a separator (6, 6') for depleting pollutants (33) from the extracted steam-air mixture (5'), wherein the cooling device (30) has a first and a second cooling chamber (1, 1') which are arranged one behind the other in a casting direction (G) within the strand guide device (10);

wherein the first and the second cooling chamber (1, 1') are connected to one another via an air duct (50); and wherein an air washer (52) is arranged in the air duct (50) for filtering and/or cleaning a steam-air mixture (5') flowing in the air duct (50) counter to the casting direction (G) from the second cooling chamber (1') arranged further downstream in the casting direction of the first cooling chamber (1).

* * * * *